US009583070B2

(12) United States Patent
Lin et al.

(10) Patent No.: US 9,583,070 B2
(45) Date of Patent: Feb. 28, 2017

(54) SIGNAL TRANSMITTING AND RECEIVING SYSTEM AND ASSOCIATED TIMING CONTROLLER OF DISPLAY

(71) Applicant: HIMAX TECHNOLOGIES LIMITED, Tainan (TW)

(72) Inventors: Chan-Fei Lin, Tainan (TW); Yu-Shan Chu, Tainan (TW); Guo-Ming Lee, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 207 days.

(21) Appl. No.: 14/669,001

(22) Filed: Mar. 26, 2015

(65) Prior Publication Data

US 2016/0284313 A1 Sep. 29, 2016

(51) Int. Cl.

| | |
|---|---|
| ***G09G 5/00*** | (2006.01) |
| ***G09G 3/36*** | (2006.01) |
| ***G09G 5/18*** | (2006.01) |

(52) U.S. Cl.

CPC ..... *G09G 5/008* (2013.01); *G09G 3/36* (2013.01); *G09G 5/18* (2013.01); *G09G 2300/0426* (2013.01); *G09G 2330/06* (2013.01); *G09G 2330/12* (2013.01); *G09G 2352/00* (2013.01); *G09G 2370/08* (2013.01)

(58) Field of Classification Search

CPC ..... G09G 3/36; G09G 3/3685; G09G 5/00; G09G 5/008; H04N 5/232

See application file for complete search history.

(56) References Cited

U.S. PATENT DOCUMENTS

| | | | | |
|---|---|---|---|---|
| 2010/0315401 | A1 | 12/2010 | Su | |
| 2014/0118235 | A1* | 5/2014 | Hong | G09G 5/008 345/87 |
| 2015/0187315 | A1* | 7/2015 | Park | G09G 3/3685 345/99 |

FOREIGN PATENT DOCUMENTS

| | | | |
|---|---|---|---|
| CN | 1264135 | C | 7/2006 |
| CN | 101211026 | B | 4/2011 |
| TW | 201044481 | A1 | 12/2010 |

* cited by examiner

*Primary Examiner* — Lun-Yi Lao
*Assistant Examiner* — Johny Lau
(74) *Attorney, Agent, or Firm* — Winston Hsu; Scott Margo

(57) ABSTRACT

A signal transmitting and receiving system of a display includes a timing controller and at least one source driver. The timing controller is arranged for transmitting a training signal and a data signal. The source driver is coupled to the timing controller via at least one data channel and a lock channel, and is arranged for receiving the training signal and the data signal via the data channel. The timing controller transmits the training signal or the data signal to the source driver by referring to a voltage level of the lock channel, and the voltage level of the lock channel is allowed to be controlled by both the timing controller and the source driver.

13 Claims, 8 Drawing Sheets

SIGNAL TRANSMITTING AND RECEIVING SYSTEM AND ASSOCIATED TIMING CONTROLLER OF DISPLAY

BACKGROUND OF THE INVENTION

1. Field of the Invention

The present inventions relates to a display, and more particularly, to a signal transmitting and receiving system and associated timing controller of a display.

2. Description of the Prior Art

In a conventional point-to-point (P2P) timing controller, frame data is transmitted to a plurality of source drivers by using a single data rate. However, using a single data rate to transmit the frame data will cause a high electromagnetic interference (EMI) peak. In addition, because the P2P timing controller uses a Serializer/Deserializer (SerDes) interface to transmit the frame data, and the data rate is very high (e.g. more than 1 Gb/s), therefore, the conventional spread spectrum techniques are difficult to be applied to the P2P timing controller.

In addition, in a display system, the timing controller is connected to the source driver(s) via at least one data channel (data lines) and a lock channel. A voltage level of the lock channel is determined by the source driver, and the timing controller refers to the voltage level of the lock channel to determine to transmit a training signal or a data signal to the source driver. In detail, when the display system is powered on, the voltage level of the lock channel is controlled to correspond to a logic value "0", the timing controller transmits the training signal to the source driver, and a clock and data recovery (CDR) included in the source driver is used to generate an internal clock by locking frequency and phase according to the training signal from the timing controller. After the source driver confirms that the frequency and phase of the internal clock are locked, the source driver controls the lock channel to have the voltage level corresponds to a logic value "1". When the voltage level of the lock channel corresponds to the logic value "1", the timing controller transmits the data signal to the source driver, and the CDR included in the source driver uses the internal clock to sample the data signal to generate recovered data.

In the conventional display system mentioned above, when a data rate of the data signal is changed during the voltage level of the lock channel having the logic value "1", the CDR may happen a dead lock event and fail to use the internal clock to sample the data signal to generate the correct recovered data.

SUMMARY OF THE INVENTION

It is therefore an objective of the present invention to provide a signal transmitting and receiving system and associated timing controller of a display, whose lock channel can be controlled by both the timing controller and the source driver, to solve the above-mentioned problems.

According to one embodiment of the present invention, a signal transmitting and receiving system of a display comprises a timing controller and at least one source driver. The timing controller is arranged for transmitting a training signal and a data signal. The source driver is coupled to the timing controller via at least one data channel and a lock channel, and is arranged for receiving the training signal and the data signal via the data channel. The timing controller transmits the training signal or the data signal to the source driver by referring to a voltage level of the lock channel, and the voltage level of the lock channel is allowed to be controlled by both the timing controller and the source driver.

According to another embodiment of the present invention, a timing controller of a display is coupled to a source driver via at least one data channel and a lock channel, the timing controller transmits a training signal or a data signal to the source driver by referring to a voltage level of the lock channel, and the voltage level of the lock channel is allowed to be controlled by both the timing controller and the source driver.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ." The terms "couple" and "couples" are intended to mean either an indirect or a direct electrical connection. Thus, if a first device couples to a second device, that connection may be through a direct electrical connection, or through an indirect electrical connection via other devices and connections.

Figure 1:
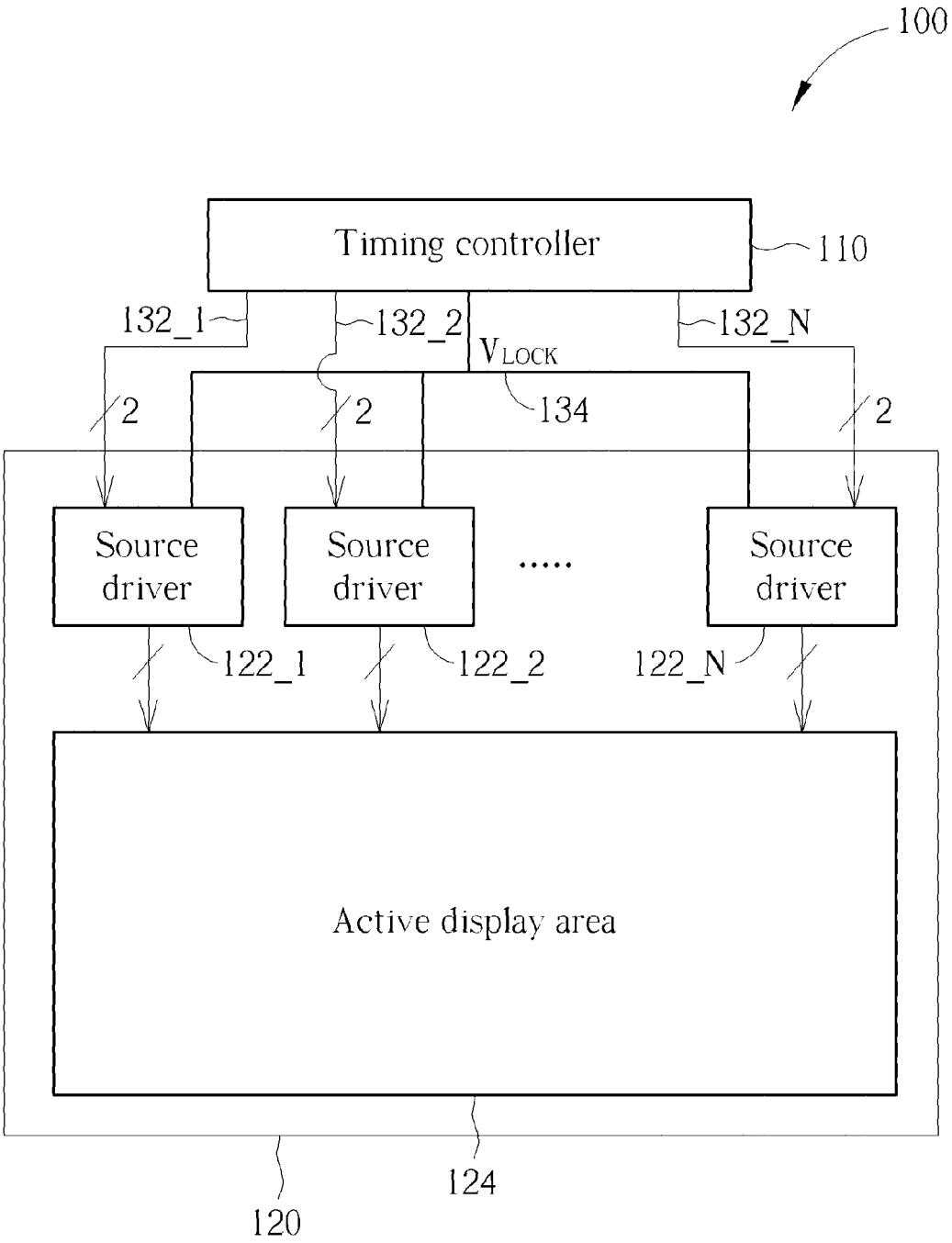
FIG. 1 is a diagram illustrating a display system according to one embodiment of the present invention.

Please refer to FIG. 1, which is a diagram illustrating a display system 100 according to one embodiment of the present invention. As shown in FIG. 1, the display system 100 comprises a timing controller 110 and a display panel 120, where the display panel 120 comprises at least one source driver (in this embodiment there are a plurality of source drivers 122_1-122_N) and an active display area 124 (the active display area 124 is also named as an active array). In this embodiment, the timing controller 110 is a P2P timing controller, and the timing controller 110 uses a Serializer/Deserializer (SerDes) interface to transmit frame data to the source drivers 122_1-122_N, respectively, and the display system 100 is a liquid crystal display (LCD).

In addition, in the display system 100, the timing controller 110 is coupled to each of the source drivers 122_1-122_N via at least one data channel (in this embodiment there are two data channels for differential signals) and a lock channel to serve as a signal transmitting and receiving system. In detail, the timing controller 110 is coupled to the source driver 122_1 via data channels 132_1 and a lock channel 134, the timing controller 110 is coupled to the source driver 122_2 via data channels 132_2 and the lock channel 134, . . . and the timing controller 110 is coupled to the source driver 122_3 via data channels 132_3 and the lock channel 134. Each of the data channels 132_1-132_N is used to transmit a training signal or a data signal such as R/G/B data and control data from the timing controller 110 to the source drivers 122_1-122_N, and the lock channel 134 is used to provide a voltage level $V_{LOCK}$ for the timing controller 110 and the source drivers 122_1-122_N to determine their operation states. Particularly, in this embodiment, the voltage level $V_{LOCK}$ of the lock channel 134 is allowed to be controlled by both the timing controller 110 and the source drivers 122_1-122_N.

Figure 2:
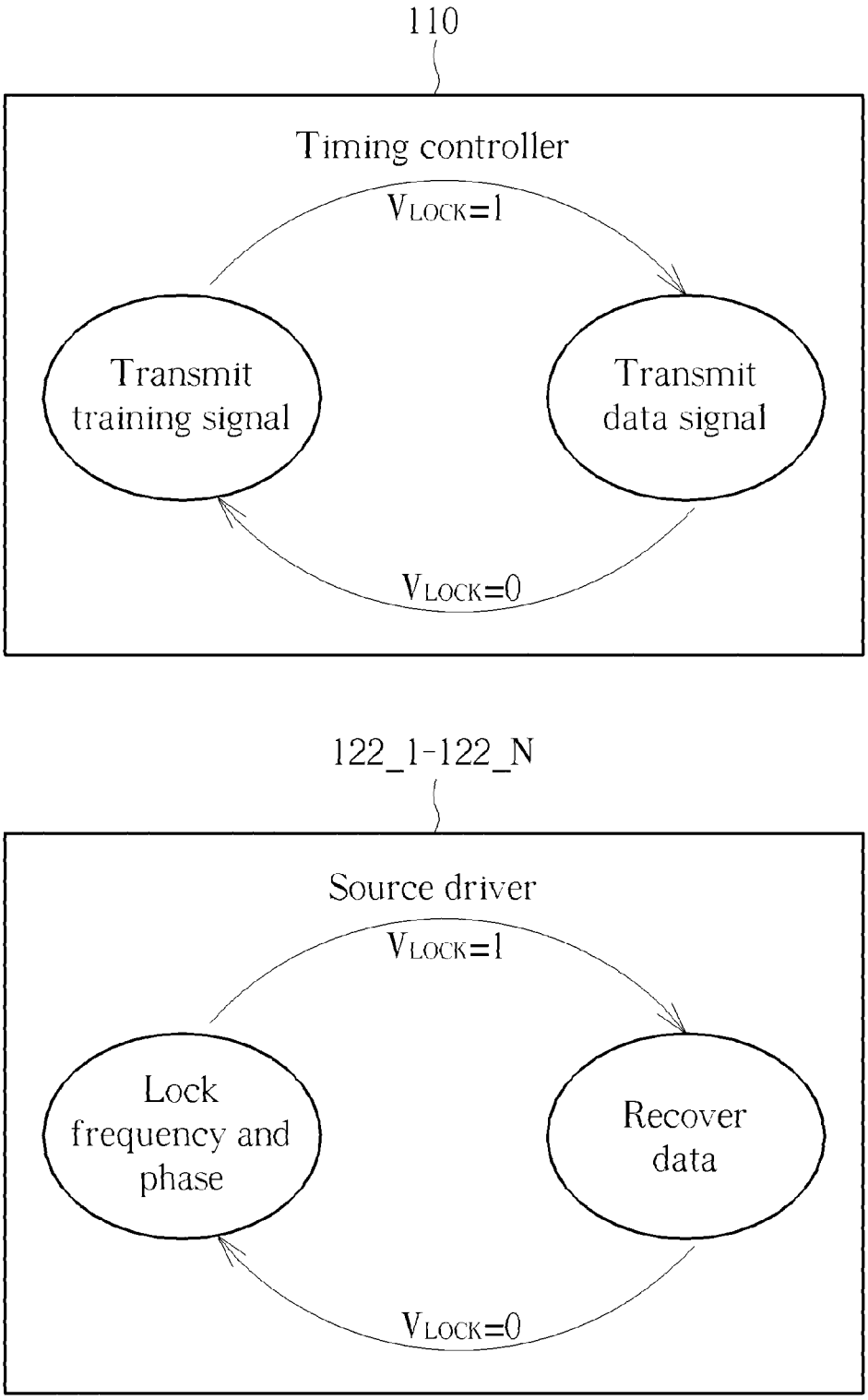
FIG. 2 is a diagram illustrating the operation states of the timing controller and the source driver according to one embodiment of the present invention.

Please refer to FIG. 2, which is a diagram illustrating the operation states of the timing controller 110 and the source driver 122_1 according to one embodiment of the present invention. As shown in FIG. 1, when one of the timing controller 110 and the source drivers 122_1-122_N controls the lock channel 134 to have the voltage level corresponding to a logic value "0" (i.e. $V_{LOCK}$=0), the timing controller 110 enters a training state and transmits the training signal (e.g. a clock signal) to the source drivers 122_1-122_N via the data channels 132_1-132_N, respectively; at this time, each of the source drivers 122_1-122_N receives the training signal, and a clock and data recovery (CDR) included in each of the source drivers 122_1-122_N is used to generate an internal clock by locking frequency and phase according to the training signal. When the one of the timing controller 110 and the source drivers 122_1-122_N controls the lock channel 134 to have the voltage level corresponding to a logic value "1" (i.e. $V_{LOCK}$=1), the timing controller 110 enters a normal state and transmits the data signal to the source drivers 122_1-122_N via the data channels 132_1-132_N, respectively; at this time, each of the source drivers 122_1-122_N receives the data signal, and the CDR included in each of the source drivers 122_1-122_N uses the internal clock to sample the data signal to generate recovered data for further use.

Figure 3:
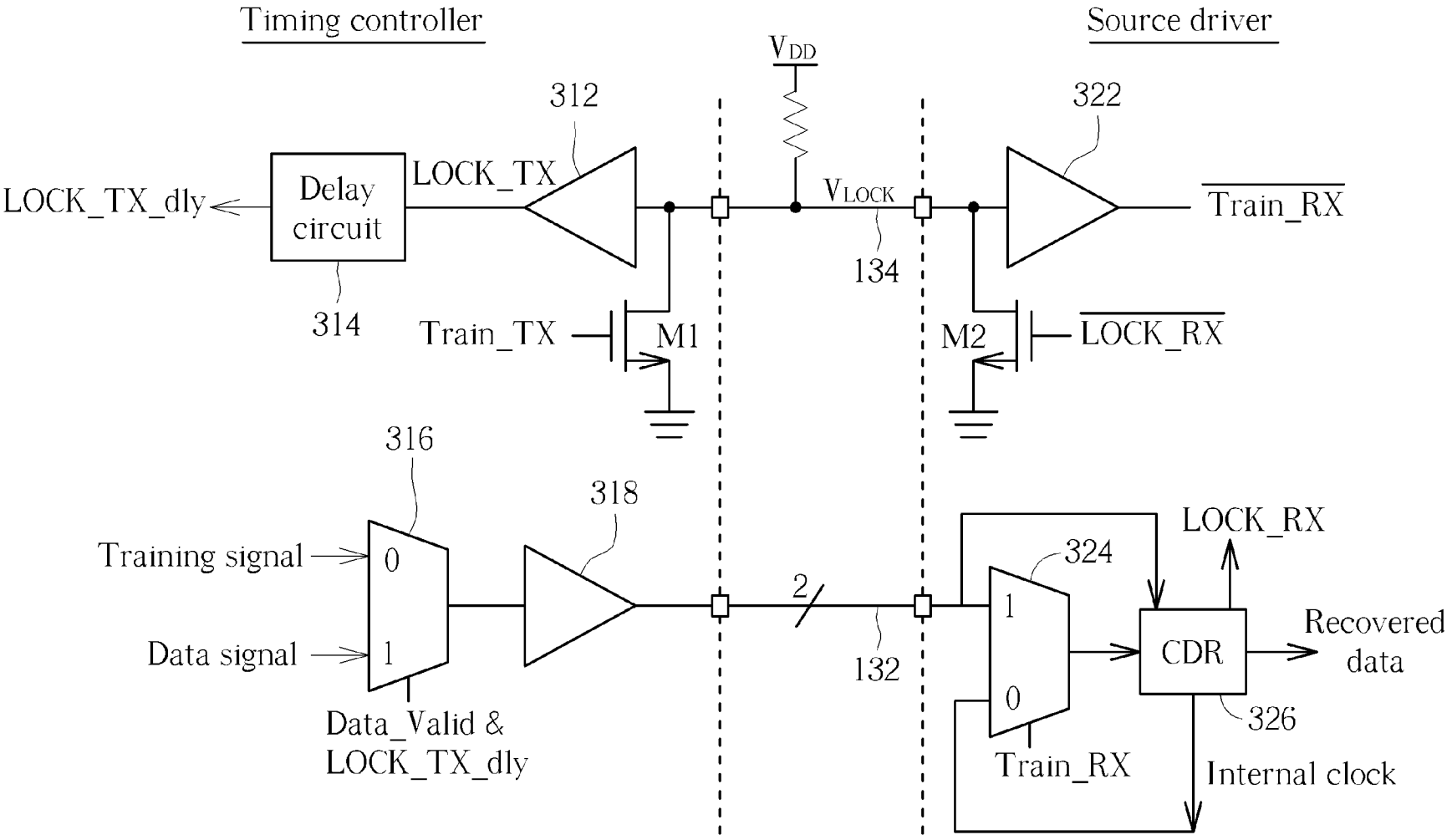
FIG. 3 is a diagram illustrating detailed circuit structure of the timing controller and the source driver according to one embodiment of the present invention.

Please refer to FIG. 3, which is a diagram illustrating detailed circuit structure of the timing controller 110 and the source driver 122_1 according to one embodiment of the present invention. As shown in FIG. 3, the timing controller 110 comprises a control circuit (in this embodiment, the control circuit is implemented by a transistor M1), two buffers 312, 318, a delay circuit 314 and a multiplexer 316. In addition, the source driver 122_1 comprises a control circuit (in this embodiment, the control circuit is implemented by a transistor M2), a buffer 322, a multiplexer 324 and a CDR 326.

In FIG. 3, a signal Train_TX in the timing controller 110 and a signal LOCK_RX in the source driver 122_1 are used to control the voltage level $V_{LOCK}$ of the lock channel 134, where the signal Train_TX is generated inside the timing controller 110, and the signal LOCK_RX is generated from the CDR 326 of the source driver 122_1. In the TX side (i.e. the timing controller 110), the buffer 312 outputs a signal LOCK_TX according to the voltage level $V_{LOCK}$ of the lock channel 134, the delay circuit 314 delays the signal LOCK_TX to generate a signal LOCK_TX_dly, and the multiplexer 316 selectively outputs the training signal or the data signal to the data channel 132 via the buffer 318 by referring to a data valid signal Data_Valid and the signal LOCK_TX_dly. In addition, in the RX side (i.e. the source driver 122_1), the buffer 322 outputs a signal $\overline{\text{Train_RX}}$ according to the voltage level $V_{LOCK}$ of the lock channel 134, and the multiplexer 324 selectively outputs the training signal/data signal from the data channel 132 or the internal clock generated inside to the CDR 326 by referring to a signal Train_RX whose phase is opposite to that of the signal $\overline{\text{Train_RX}}$.

There are at least two situations that the lock channel 134 will be pulled down to have the voltage level corresponding to the logic value "0" (i.e. $V_{LOCK}$=0) when the timing controller 110 is in the normal state, one is that the internal clock of the source driver 122_1 is out of lock, and the other one is that the timing controller 110 needs to change/alter a data rate of the data signal. When the internal clock of the source driver 122_1 is out of lock, the source driver 122_1 may pull down the voltage level of the lock channel 134 to make the timing controller 110 enter the training state and transmit the training signal, and the source driver 122_1 uses the training signal from the timing controller 110 to re-generate the internal clock. In addition, when the timing controller 110 needs to change/alter the data rate of the data signal, the timing controller 110 automatically pulls down the voltage level of the lock channel 134 and enters the training state to force the source driver 122_1 to re-generate the internal clock. The above-mentioned two situations are described in the following descriptions with FIG. 4 and FIG. 5.

Figure 4:
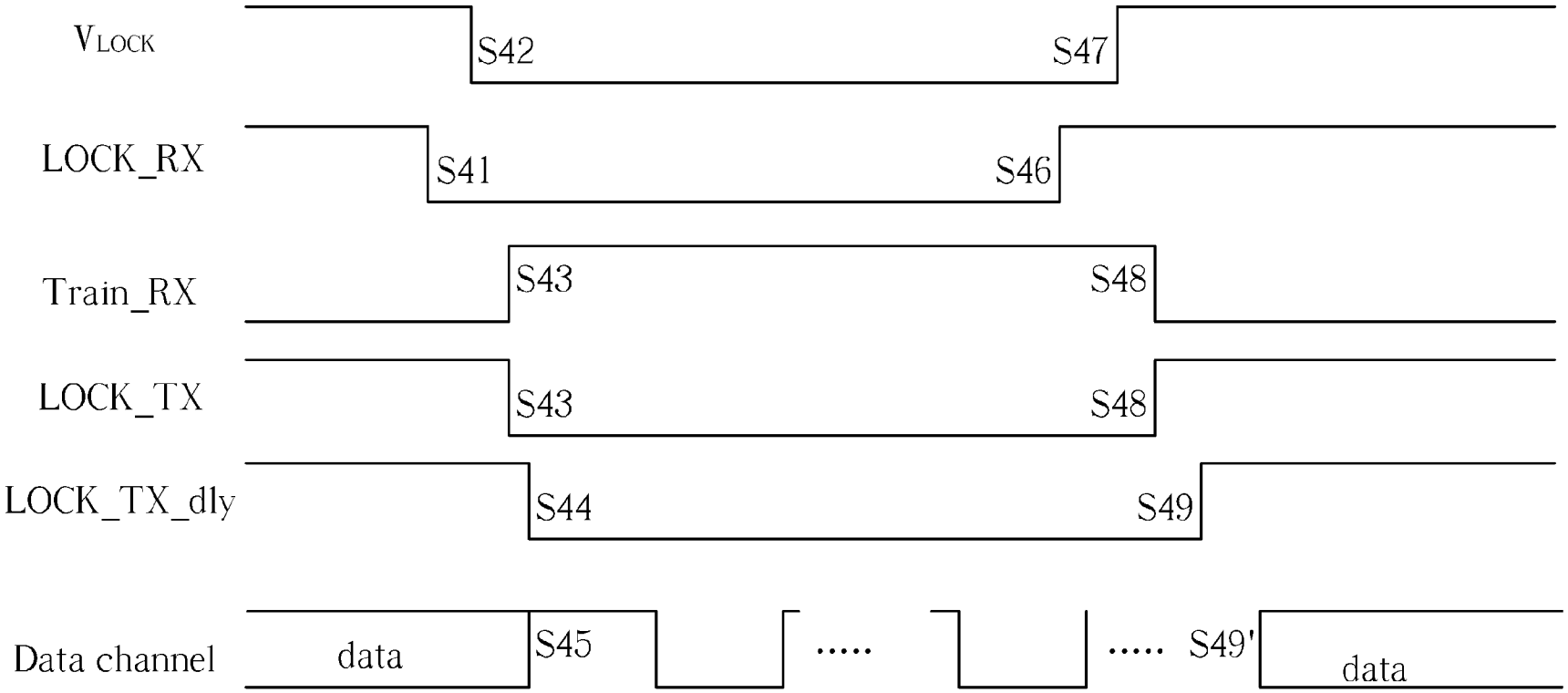
FIG. 4 is a timing diagram of the signals shown in FIG. 3 when the CDR of the source driver is out of lock.

Please refer to FIG. 3 and FIG. 4 together, FIG. 4 is a timing diagram of the signals shown in FIG. 3 when the internal clock of the source driver 122_1 is out of lock. It is noted that the signal Train_TX is assumed to be "0" in FIG. 4. As shown in FIG. 4, when the CDR 326 determines that the internal clock is out of lock, the CDR 326 changes a voltage level of the signal LOCK_RX (Step S41) to make the transistor M2 pull down the voltage level $V_{LOCK}$ of the lock channel 134 to a ground (Step S42). Then, voltage levels of the signals LOCK_TX and Train_RX are changed accordingly (Step S43), and the delay circuit 314 delays the signal LOCK_TX to generate the signal LOCK_TX_dly (Step S44). Then, the multiplexer 316 starts to output the training signal to the source driver 122_1 by referring to the data valid signal Data_Valid (assuming that Data_Valid=1) and the signal LOCK_TX_dly (Step S45), and the multiplexer 324 outputs the training signal to the CDR 326 by referring to the signal Train_RX, and the CDR 326 starts to generate the internal clock by locking frequency and phase according to the training signal.

After the phase and frequency of the internal clock are locked, the CDR 326 changes the voltage level of the signal LOCK_RX again (Step S46) to switch off the transistor M2 to make the voltage level $V_{LOCK}$ be pulled high by a supply voltage $V_{DD}$ (Step S47). Then, voltage levels of the signals LOCK_TX and Train_RX are changed accordingly (Step S48), and the delay circuit 314 delays the signal LOCK_TX to generate the signal LOCK_TX_dly (Step S49). Then, the multiplexer 316 starts to output the data signal to the source driver 122_1 by referring to the data valid signal Data_Valid (assuming that Data_Valid=1) and the signal LOCK_TX_dly (Step S49'), and the multiplexer 324 outputs the internal clock to the CDR 326 by referring to the signal Train_RX, and the CDR 326 starts to use the internal clock to sample the data signal to generate the recovered data.

Figure 5:
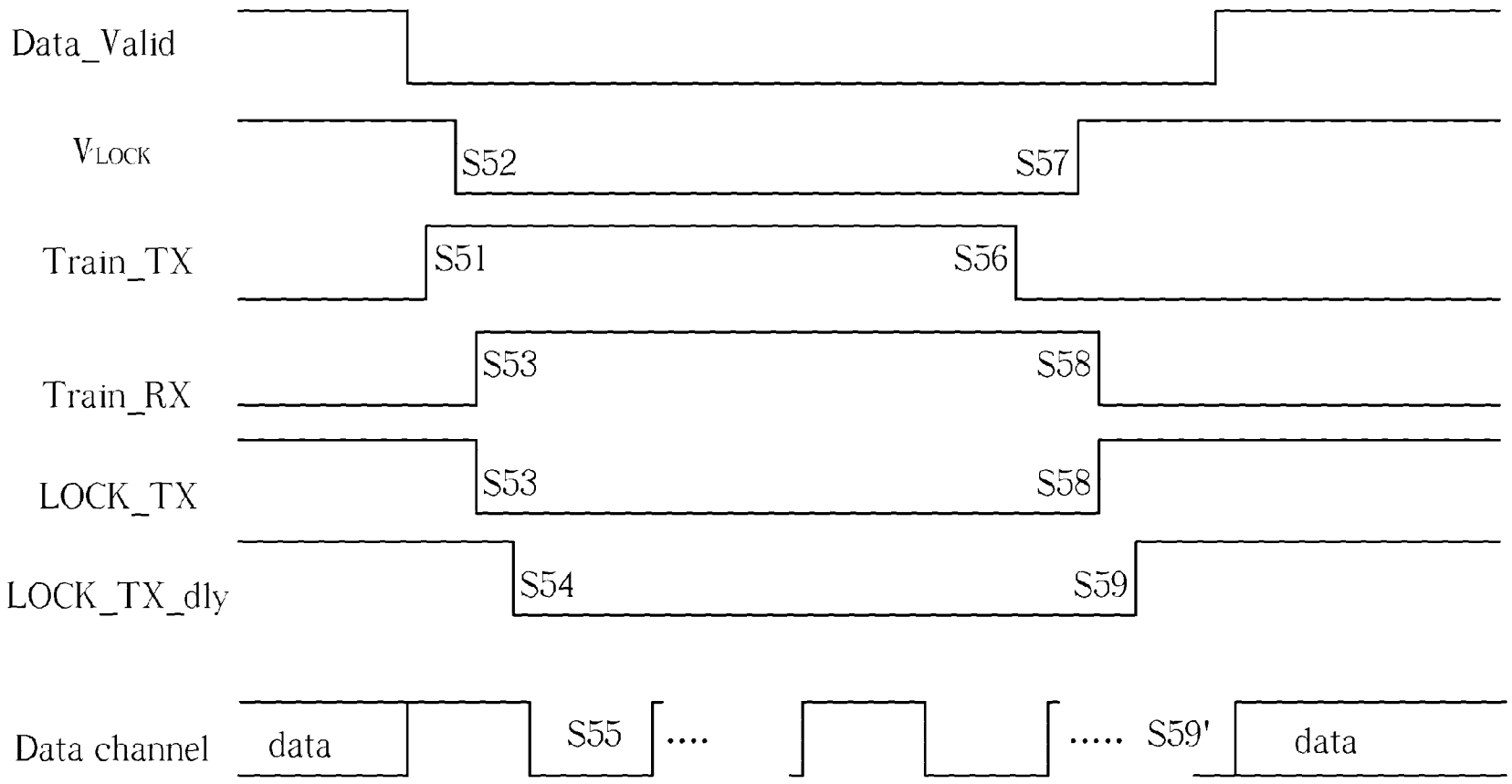
FIG. 5 is a timing diagram of the signals shown in FIG. 3 when the timing controller changes the data rate of the data signal.

Please refer to FIG. 3 and FIG. 5 together, FIG. 5 is a timing diagram of the signals shown in FIG. 3 when the timing controller 110 changes the data rate of the data signal. As shown in FIG. 5, during Data_Valid=0, the multiplexer 316 in the timing controller 110 starts to output the training signal to the source driver 122_1 by referring to the data valid signal Data_Valid and the signal LOCK_TX_dly. Therefore, timing controller 110 can change data rate during this period. In detail, when the timing controller 110 needs to use different data rate to transmit the data signal, the timing controller 110 changes a voltage level of the signal Train_TX (Step S51) to switch on the transistor M1 to make the transistor M1 pull down the voltage level $V_{LOCK}$ of the lock channel 134 to the ground (Step 52). Then, voltage levels of the signals LOCK_TX and Train_RX are changed accordingly (Step S53). Then, the delay circuit 314 delays the signal LOCK_TX to generate the signal LOCK_TX_dly (Step S54), and the multiplexer 316 outputs the training signal to the source driver 122_1 (Step S55). Then, The multiplexer 324 outputs the training signal to the CDR 326 by referring to the signal Train_RX, and the CDR 326 starts to generate the internal clock by locking frequency and phase according to the training signal.

After a specific period of time from the step S51, the timing controller 110 changes the voltage level of the signal Train_TX again (Step S56) to switch off the transistor M1 to make the voltage level $V_{LOCK}$ be pulled high by the supply voltage $V_{DD}$ (Step S57). Then, voltage levels of the signals LOCK_TX and Train_RX are changed accordingly (Step S58), and the delay circuit 314 delays the signal LOCK_TX to generate the signal LOCK_TX_dly (Step S59). Then, the multiplexer 316 starts to output the data signal to the source driver 122_1 by referring to the data valid signal Data_Valid (assuming that Data_Valid also changes from 0 to 1) and the signal LOCK_TX_dly (Step S59'), and the multiplexer 324 outputs the internal clock to the CDR 326 by referring to the signal Train_RX, and the CDR 326 starts to use the internal clock to sample the data signal to generate the recovered data.

It is noted that the signal LOCK_RX is ignored in FIG. 5 for brevity, and it is assumed that the CDR 326 successfully generate the appropriate internal clock before the step S56. A person skilled in the art should understand how to modify the timing diagram shown in FIG. 5 when the CDR 326 successfully generate the appropriate internal clock after the step S56 after reading the above-mentioned descriptions, further descriptions are therefore omitted here.

In addition, for the transmission of the data signal, the timing controller 110 applies a plurality of data rates to a discrete data rate setting, then the timing controller 110 sequentially receives image data of a plurality of frames, and transmits the (processed) image data of the plurality of frames to each of the source drivers 122_1-122_N by using the plurality of data rates, respectively, where for each of the frames, its corresponding image data is transmitting by using only one of the data rates. Then, after receiving the image data from the timing controller 110, the source drivers 122_1-122_N transmits corresponding data to data lines of the active display area 124.

Figure 6:
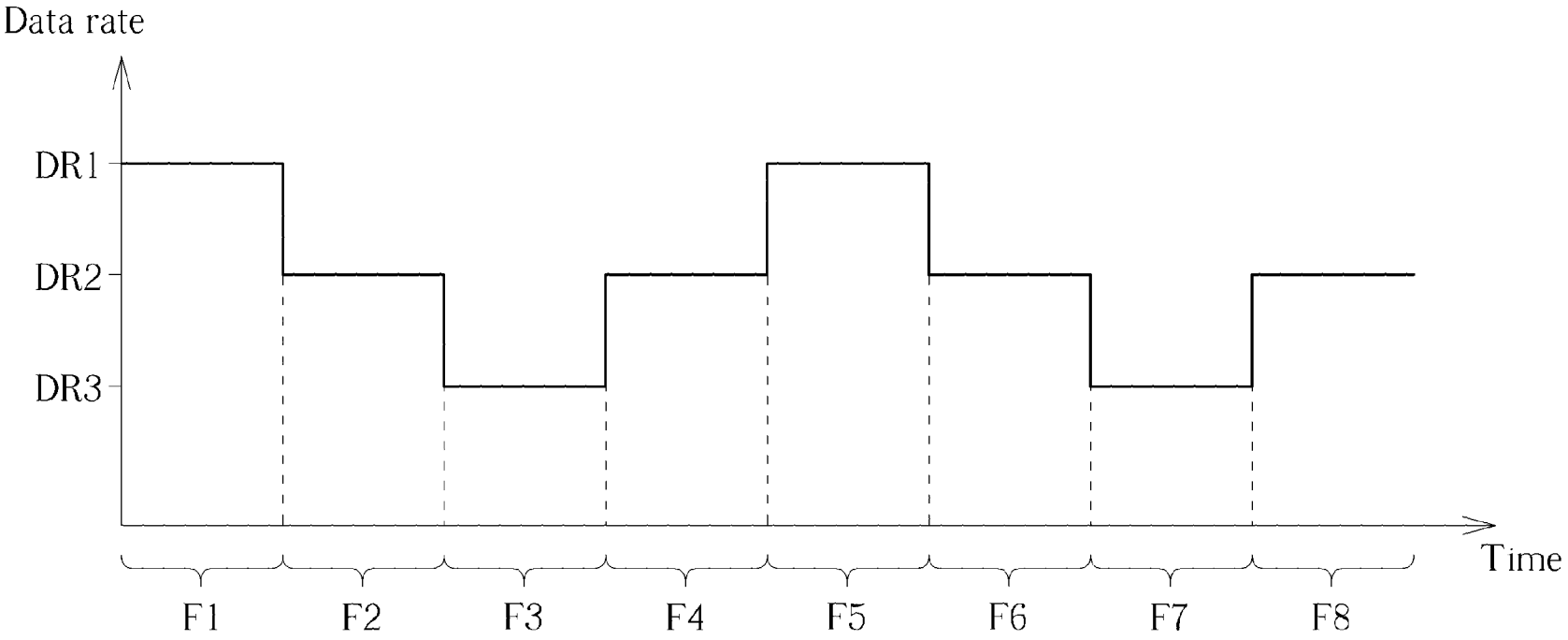
FIG. 6 is diagram showing transmitting frames by using data rates DR1-DR3 according to one embodiment of the present invention.

In detail, referring to FIG. 6, which is diagram showing transmitting frames by using data rates DR1-DR3 according to one embodiment of the present invention. Referring to FIG. 6, the timing controller 110 uses the data rate DR1 to transmit image data of the first frame F1 to the source drivers 122_1-122_N, uses the data rate DR2 to transmit image data of the second frame F2 to the source drivers 122_1-122_N, uses the data rate DR3 to transmit image data of the third frame F3 to the source drivers 122_1-122_N, uses the data rate DR2 to transmit image data of the fourth frame F4 to the source drivers 122_1-122_N, and repeatedly uses the data rates DR1, DR2, DR3, DR2 to transmit the following frames F5, F6, F7, F8, respectively, . . . . By using different data rates to transmit the frame data, the EMI peak can be effectively reduced.

It is noted that FIG. 6 is merely for illustrative purposes only, and is not a limitation of the present invention. For example, a number of data rates can be determined according to the designer's consideration, that is the timing controller 110 may use two, four or five different data rates to transmit frame data; FIG. 6 shows that the image data of any two adjacent frames is transmitted by using different data rates, respectively, however, in other embodiments, the image data of some adjacent frames can be transmitted by using the same data rate, for example, using the data rate DR1 to transmit the frames F1-F2 and F4-F5, and using the data rate DR2 to transmit the frames F3 and F6; and in other embodiments, the data rates are not periodically used to transmit the image data of the frames. These alternative designs shall fall within the scope of the present invention.

Figure 7:
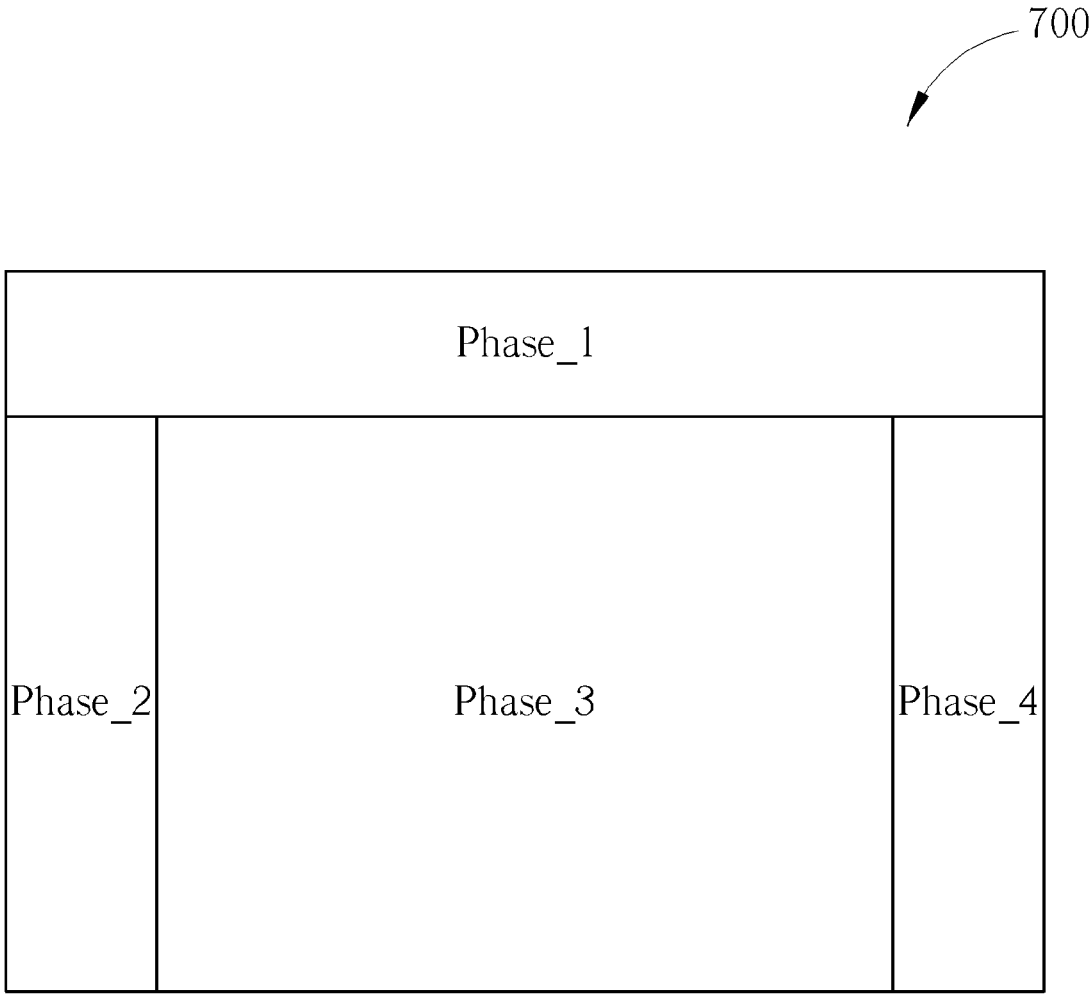
FIG. 7 is a diagram illustrating a format of a frame according to one embodiment of the present invention.

Please refer to FIG. 7, which is a diagram illustrating a format of a frame 700 according to one embodiment of the present invention. Referring to FIG. 7, the frame 700 comprises active image data and inactive data, the active image data is used to be displayed on the active display area 124, that is "Phase_3" shown in FIG. 7; and the inactive data is not displayed on the active display area 124, that is the vertical blanking interval (VBI) data, that is "Phase_1" shown in FIG. 7, and the horizontal blanking interval (HBI) data, that is "Phase_2" and "Phase_4" shown in FIG. 7. In this embodiment, the timing controller 110 switches the data rate during transmitting the VBI data to the source drivers 122_1-122_N. In detail, when transmitting the VBI data of the frame 700 to the source drivers, the hardware or a microprocessor (MCU) built in the timing controller 110 executes a code to switch an oscillator frequency offset to switch the data rate used to transmit the image data of the frame 700.

Figure 8:
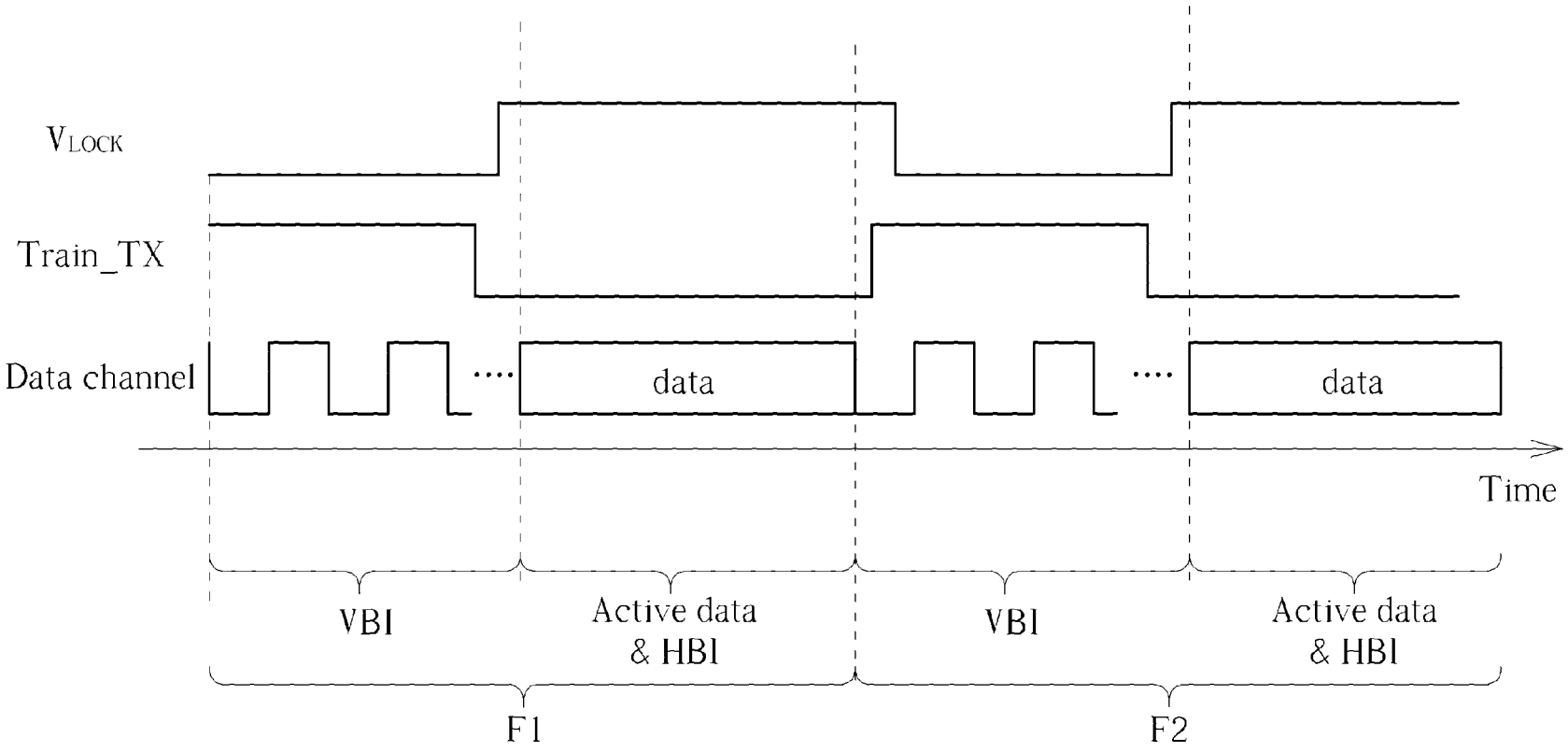
FIG. 8 is a timing diagram illustrating the signals $V_{LOCK}$ and Train_TX for the frames.

Please refer to FIG. 8, which is a timing diagram illustrating the signals $V_{LOCK}$ and Train_TX for the frames F1 and F2. As shown in FIG. 6 and FIG. 8, the data rate is changed/altered at the beginning of each frame, and during a period that the VBI data is transmitted, the signal Train_TX becomes "1", and the timing controller 110 enters the training state and transmits the training signal to the source drivers 112_1-112_N for generating the appropriate internal clock. During a period that the active data and HBI data is transmitted, the signal Train_TX becomes "0", and the timing controller 110 enters the normal state to transmits the data signal to the source drivers 112_1-112_N. In addition, in one embodiment, when VBI data is transmitted, the data valid signal Data_Valid shown in FIG. 3 may be set to have the logic value "0"; and when the active data is transmitted, the data valid signal Data_Valid shown in FIG. 3 may be set to have the logic value "1".

It is noted that timing diagram of the signal Train_TX shown in FIG. 8 is for illustrative purposes only, and is not a limitation of the preset invention. In other embodiment, the signal Train_TX can be "1" during any specific period after a switch timing switching timing of the data rates and within the period that the VBI data is transmitted. As long as the voltage level of signal Train_TX is determined based on the switching timing of the data rates, these alternative designs shall fall within the scope of the present invention.

Briefly summarized, in the present invention, the lock channel can be controlled by both the timing controller and the source driver. Therefore, when the internal clock of the source driver is out of lock, or when the timing needs to change the data rate of the data signal, the voltage level of the lock channel can be accurately and immediately determined to make the source driver immediately enter the lock frequency and phase state, to prevent from the dead lock event of the CDR.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A signal transmitting and receiving system of a display, comprising:

a timing controller, for transmitting a training signal and a data signal; and at least one source driver, coupled to the timing controller via at least one data channel and a lock channel, for receiving the training signal and the data signal via the data channel, wherein the source driver comprises:

a clock and data recovery (CDR) circuit, for receiving the training signal to generate an internal clock, and using the internal clock to sample the data signal to generate recovered data; and a multiplexer, coupled to the data channel, for receiving the training signal or the data signal from the data channel and the internal clock from the CDR circuit, and for selectively outputting the training signal/data signal or the internal clock to the CDR circuit by referring to the voltage level of the lock channel;

wherein the timing controller comprises:

a delay circuit, for delaying a signal to generate a delayed signal, wherein the signal is generated according to the voltage level of the lock channel; and a multiplexer, for receiving the training signal and the data signal, and selectively outputting the training signal or the data signal to the source driver by referring to at least the delayed signal;

wherein the voltage level of the lock channel is allowed to be controlled by both the timing controller and the source driver.

2. The signal transmitting and receiving system of claim 1, wherein when the voltage level of the lock channel corresponds to a first logic value, the CDR circuit receives the training signal from the timing controller and generates the internal clock according to the training signal; and when the voltage level of the lock channel corresponds to a second logic value, the CDR circuit receives the data signal from the timing controller and uses the internal clock to sample the data signal to generate the recovered data.

3. The signal transmitting and receiving system of claim 1, wherein the timing controller comprises:

a control circuit, for controlling the voltage level of the lock channel by referring to a control signal generated inside the timing controller.

4. The signal transmitting and receiving system of claim 3, wherein the timing controller applies a plurality of data rates to a discrete data rate setting, and the timing controller transmits the data signal by using the plurality of data rates, respectively; and the control signal is generated according to switching timing of the data rates.

5. The signal transmitting and receiving system of claim 4, wherein during a specific period after each switching timing of the data rates, the control circuit controls the voltage level of the lock channel to make the timing controller transmit the training signal to the source driver and make the source driver enter lock frequency and phase state.

6. The signal transmitting and receiving system of claim 5, wherein the data signal comprises image data of a plurality of frames, and for each of the frames, its corresponding image data is transmitting by using only one of the data rates, and each frame comprises active image data and inactive data, the active image data is used to be displayed on an active display area of a display panel, the inactive data is not displayed on the active display area of the display panel; and the specific period corresponds to the inactive data of each frame.

7. The signal transmitting and receiving system of claim 6, wherein the specific period corresponds to a vertical blanking interval (VBI) data of each frame.

8. A timing controller of a display, wherein the timing controller is coupled to a source driver via at least one data channel and a lock channel, the timing controller transmits a training signal or a data signal to the source driver by referring to a voltage level of the lock channel, and the voltage level of the lock channel is allowed to be controlled by both the timing controller and the source driver, wherein the source driver comprises:

a clock and data recovery (CDR) circuit, for receiving the training signal to generate an internal clock, and using the internal clock to sample the data signal to generate recovered data; and a multiplexer, coupled to the data channel, for receiving the training signal or the data signal from the data channel and the internal clock from the CDR circuit, and for selectively outputting the training signal/data signal or the internal clock to the CDR circuit by referring to the voltage level of the lock channel;

wherein the timing controller comprises:

a delay circuit, for delaying a signal to generate a delayed signal, wherein the signal is generated according to the voltage level of the lock channel; and a multiplexer, for receiving the training signal and the data signal, and selectively outputting the training signal or the data signal to the source driver by referring to at least the delayed signal.

9. The timing controller of claim 8, wherein the timing controller comprises:

a control circuit, for controlling the voltage level of the lock channel by referring to a control signal generated inside the timing controller.

10. The timing controller of claim 9, wherein the timing controller applies a plurality of data rates to a discrete data rate setting, and the timing controller transmits the data signal by using the plurality of data rates, respectively; and the control signal is generated according to switching timing of the data rates.

11. The timing controller of claim 10, wherein during a specific period after each switching timing of the data rates, the control circuit controls the voltage level of the lock channel to make the timing controller transmit the training signal to the source driver and make the source driver enter lock frequency and phase state.

12. The timing controller of claim 11, wherein the data signal comprises image data of a plurality of frames, and for each of the frames, its corresponding image data is transmitting by using only one of the data rates, and each frame comprises active image data and inactive data, the active image data is used to be displayed on an active display area of a display panel, the inactive data is not displayed on the active display area of the display panel; and the specific period corresponds to the inactive data of each frame.

13. The timing controller of claim 12, wherein the specific period corresponds to a vertical blanking interval (VBI) data of each frame.

* * * * *